US005425589A

United States Patent [19]

Griffin et al.

[11] Patent Number: 5,425,589

[45] Date of Patent: Jun. 20, 1995

[54] CAR WASHER

[76] Inventors: Glenn L. Griffin; Grace E. Griffin, both of 33681 Big Sur Ave., Dana Point, Calif. 92629

[21] Appl. No.: 115,812

[22] Filed: Sep. 3, 1993

[51] Int. Cl.[6] ..... A47L 13/22; A47L 13/26

[52] U.S. Cl. ..... 401/42; 401/43; 401/136; 401/203; 401/204; 401/289; 401/27; 239/289; 239/312; 239/326

[58] Field of Search ..... 401/136, 203, 204, 283, 401/46, 42, 43, 27, 289, 27; 239/289, 312, 326, 378, 526

[56] References Cited

U.S. PATENT DOCUMENTS

| | | | |
|---|---|---|---|
| 358,875 | 3/1887 | Nichols | 401/136 X |
| 906,451 | 12/1908 | Murray | 401/136 X |
| 2,348,420 | 5/1944 | Rose | 239/326 |
| 2,501,426 | 3/1950 | Voorhees | 401/43 |
| 2,514,225 | 7/1950 | Dabrohula | 401/136 X |
| 2,538,850 | 1/1951 | Simms | 401/46 X |
| 2,673,999 | 4/1954 | Shey | 401/136 |
| 3,063,084 | 11/1962 | Marinus | 401/203 |
| 3,128,949 | 4/1964 | Kaufman | 239/312 |
| 3,761,021 | 9/1973 | White | 239/312 |
| 4,971,471 | 11/1990 | Sloan | 401/203 |
| 5,154,524 | 10/1992 | Anderson | 401/204 X |

FOREIGN PATENT DOCUMENTS

| | | | |
|---|---|---|---|
| 114849 | 5/1929 | Australia | 239/378 |
| 1494879 | 9/1967 | France | 401/283 |
| 3440349 | 5/1986 | Germany | 239/289 |
| 10783 | 5/1911 | United Kingdom | 401/136 |
| 336382 | 10/1930 | United Kingdom | 401/283 |
| 483117 | 4/1938 | United Kingdom | 401/136 |

*Primary Examiner*—Steven A. Bratlie

[57] ABSTRACT

A two-piece tool inter-connected by a flexible soap water tube (12) which will perform a quick and clean car wash, void of soap film or streaks. The user simply rinses off the loose dirt and cools down the hot metal surface of a section of the car with one piece of the tool held in one hand (FIG. 18), and then washes with the other piece of the tool held in the other hand. The user again rinses with the other tool in the opposite hand to remove the soap before it dries leaving a soap film or streaks. This process is repeated until the last section of the car is completed. The user can expect about five car washes from one ounce of liquid soap before refilling and will find easy control of the rinse water flow rate and pattern whereby conserving soap and water.

16 Claims, 13 Drawing Sheets

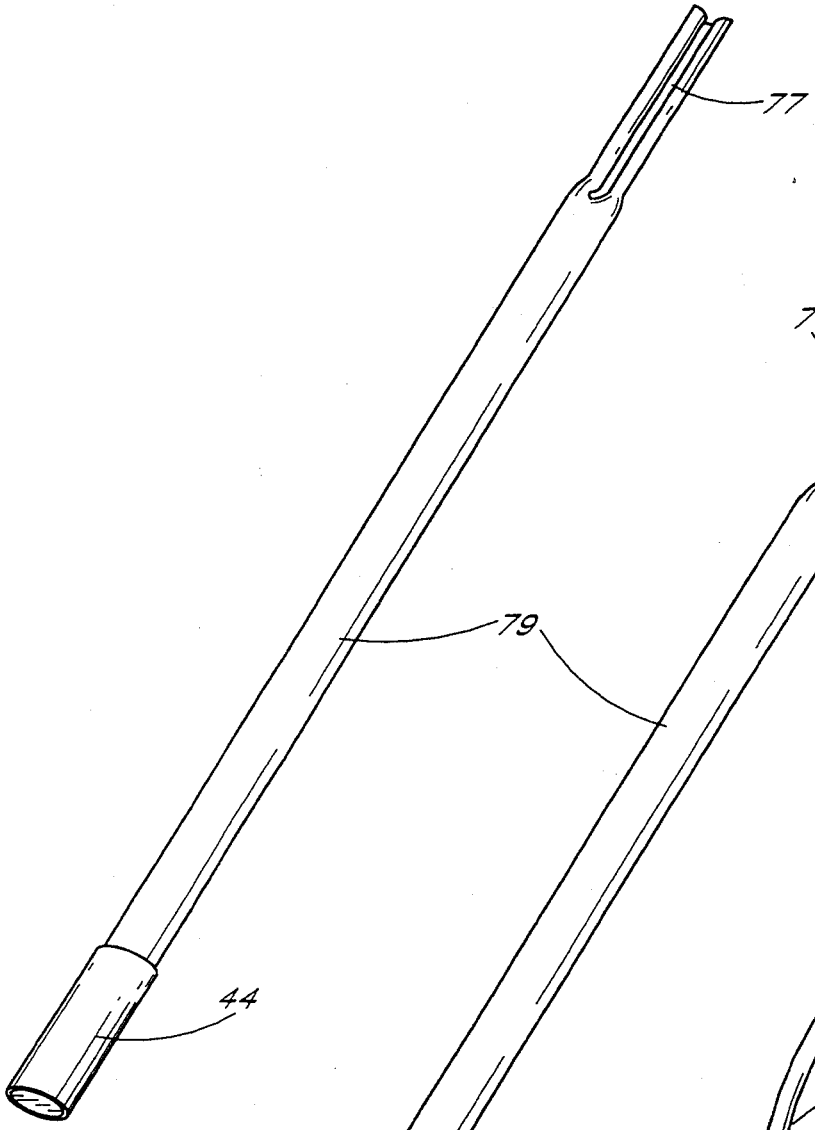
FIG. 14
FIG. 15
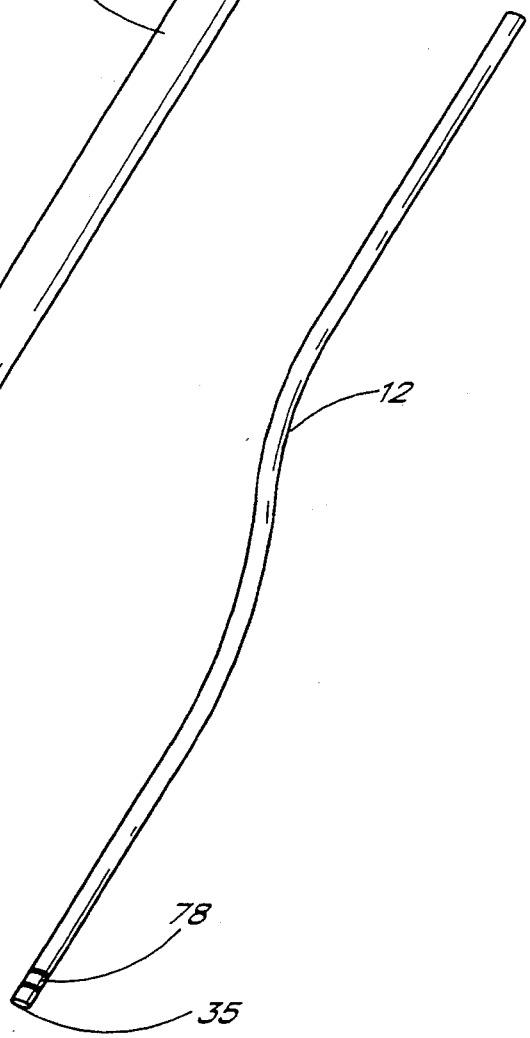
FIG. 16

CAR WASHER

BACKGROUND

1. Field of the Invention

This invention relates to car washers; for use in washing and rinsing one section of a car at a time to facilitate a quick and clean car wash and rinse without leaving a soap film or streaks and for performing a variety of other functions.

BACKGROUND

2. Description of Prior Art

Heretofore a variety of car washers have been proposed and made available. Many users have become disillusioned with them because some are cumbersome and tiring to use, others fail to get the car clean and, most leave soap streaks. Most are not very water conservative because there is no effective way to manually control the rinse water flow. None are very soap conservative. One such type car washer consists of a long tube for a handle with a brush on one end and a hose connector on the other end. When the user connects the garden hose to the car washer and turns on the water the weight and stiffness of the hose, especially when full of water, makes washing the car cumbersome and tiring because the hose has to be put through the same motions as the car washer.

Another type of car washer emits a jet spray of soapy water onto the car surface. This only breaks up the loose dirt and does not really get the car sufficiently clean and is not very soap conservative.

All car washers have inadequate means for rinsing off soap before it dries leaving a dull film and unsightly streaks on the car finish and windows. In the prior art both the soapy wash water and rinse water flow through the same parts of the car washer; therefore, it takes a while for the rinse water to flow clear of soap after turning the selector dial to the rinse position. It is difficult to determine when the rinse water is clear enough to sufficiently rinse off the soap. This method gives the soap time to dry and streak, especially in hot or windy conditions.

None of the available car washers have the means to facilitate a manually controlled instantaneous flow control rinse. This is necessary when washing one section of a car at a time so the soap does not stay on the car too long and dry, causing it to film and streak. Such means are also useful for breaking up loose dirt and cooling down the hot surfaces of a car prior to washing. Applying soapy water to a hot surface causes the soap to dry almost instantly, resulting in a dull film and soap streaks even after being rinsed and wiped dry.

None of the available car washers are recommended for use as a duster if dusting is all that is needed.

Most users, therefore would find it desirable to have a lightweight car washer that would facilitate a quick and clean car wash without leaving a soap film or streaks, and not be concerned about the hot sun or wind when washing the car. Many users would find it convenient and useful to have a complete car cleaning tool that could be used for dusting and polishing as well as washing the exterior of a car.

Many users care about waste and the environment and would like to have a car washer that is soap and water conservative.

OBJECTS AND ADVANTAGES

Our invention allows the user to pre-rinse one section of the car at a time, breaking up loose dirt and cooling down hot metal surfaces prior to washing. This facilitates a cleaner wash and prevents soap streaks because the metal is pre-cooled. That section is then washed with a soft soapy wash pad on the end of a short handle held in one hand, and then it is rinsed with clear water from a rinse nozzle assembly held in the other hand. This results in a good washing and rinsing before the soap has a chance to dry from the sun or wind and leaves soap streaks. Our invention is not at all cumbersome to use. The wash pad when dry and fluffy picks up dust particles very well and can be used for dusting instead of washing on the scheduled car cleaning days. The wash pad automatically washes itself clean the next time it is used to wash the car.

In addition, our invention can be used to wash exterior windows, R.V.'s, boats, etc. by adapting an extension handle. By adapting extension sections, our invention can be used to wash the exterior of mobile homes, semi-truck trailers, second story windows, etc.

The object and advantages of our invention to the environment are two fold: one, it saves water and two, it uses very little soap. The soap water flows into the wash pad at the rate of about two ounces per minute; therefore, the average 15 minute car wash uses less than one quart of soapy water. Rinse water is totally controlled by the user and only a sufficient amount is used. No water is wasted by letting the water run long enough to rinse out a brush and other parts of the car washer before water is clear enough to rinse. Having control over the flow pattern helps also. By using a spray rinse for the roof or hood and a narrow jet rinse for the bumpers or wheels wasteful over-spray can be minimized.

Whenever anyone washes his car in a street or driveway, whether they uses a bucket of soapy water and sponge or one of the car washers presently available, approximately one ounce of concentrated liquid soap ends up going down the gutter and into the storm drain. The soap chemicals, even if they dry before a storm comes along, will eventually be washed into the rivers, streams, creeks, canals, and oceans causing pollution to our environment. Although we have a way of treating what flows into our sewers, we have no way of treating what goes into our storm drains. So it behooves us to be careful of how much soap chemicals we put into them. Our invention will reduce the amount of soap chemicals that end up going down our storm drains by 80% to 85%.

Readers will find further objects and advantages of the invention from a consideration of the ensuing description and the accompanying drawings.

DRAWING FIGURES

FIG. 14 shows a perspective side view of an extension handle of such tool for use in washing high objects.

FIG. 15 shows a perspective side view of an extension section of such tool for use in washing high objects.

FIG. 16 shows a perspective side view of a soap water extension tube of such tool for use in washing high objects.

Two-Piece Tool—Description

Figure 1:
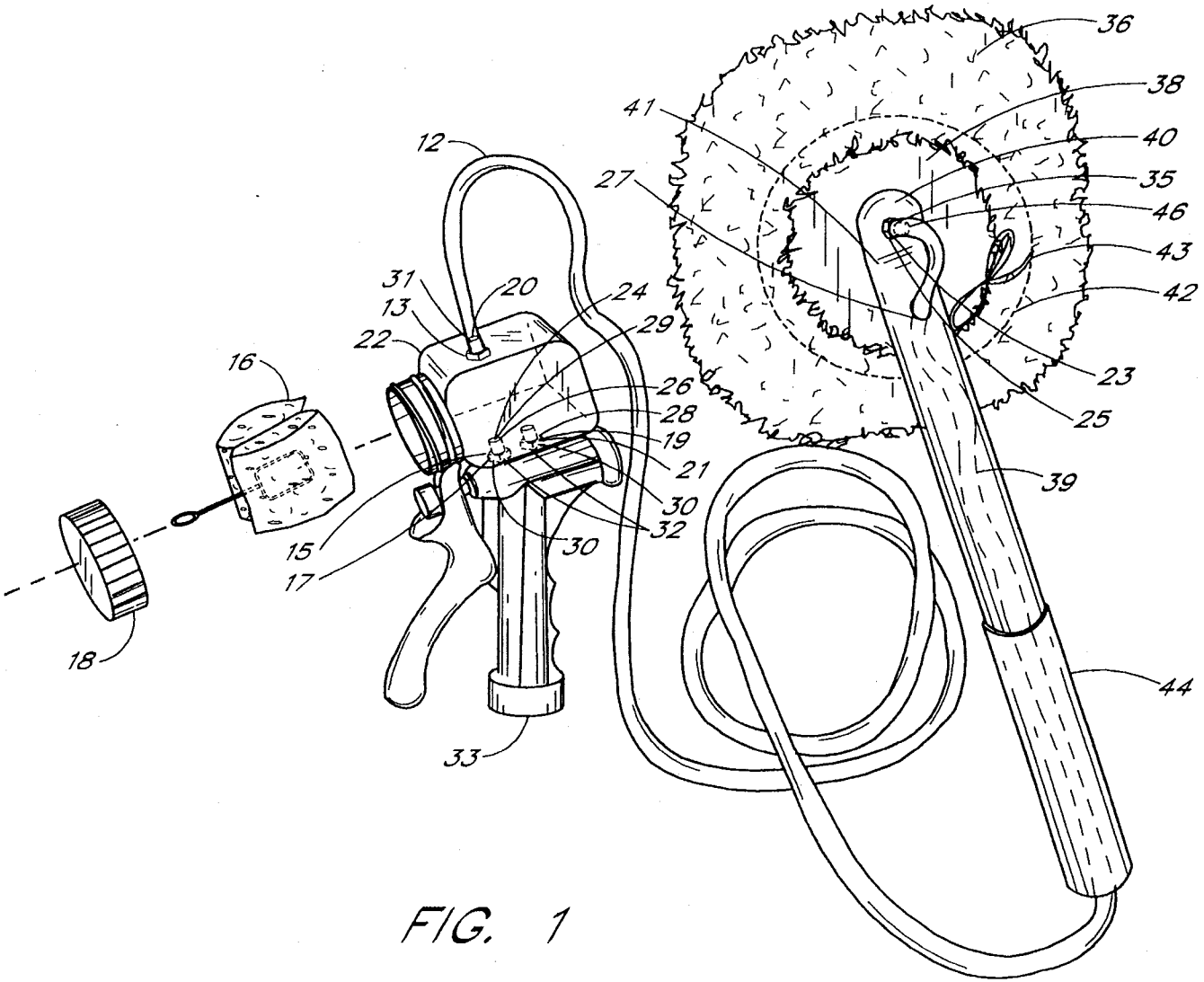
FIG. 1 shows a partially exploded perspective side and back view of a two-piece tool interconnected with a small flexible soap water tube with reference numbers according to the invention.

FIG. 1 shows a two-piece tool interconnected by a small flexible soap water tube 12 about 3/16 inches in diameter and approximately 6 feet long.

One piece of the two-piece tool comprises hose nozzle gun 33 of prior art manufactured by Gilmour Corporation (item number 501 AC) in which two mounting holes 15 and 19 about 3/16 inch in diameter have been drilled through the top side of the barrel toward the rear and spaced about ¾ inches apart. Said top side of the barrel is machined to a flat surface 34. With hose nozzle gun 33 dismantled, rear mounting post 26 is fitted with self-cleaning water jet 24 and neoprene washer 32 and is pushed up through hole 15 (nearest handle) and tightened with nut 30 to flat surface 34. Front mounting post 28 is fitted with neoprene washer 32 and pushed up through front hole 19 and tightened with nut 30 to flat surface 34. Plastic bottle 22 comprising a Silgan Plastic Corp. (item number 60CC H/M DBL) semi-clear plastic bottle about 2¾ inches long and about 1¼ inches wide is drilled with two mounting holes 17 and 21 through one side about ¾ inch apart and is placed on rear mounting post 26 and front mounting post 28 and secured with two nuts 30. Another hole 13 is drilled through the side opposite said mounting holes 17 and 21. Soap water jet 20 is pushed up through hole 13 and tightened with nut 30. Sponge 16 fitted with sponge handle 14 is squeezed into the large opening of plastic bottle 22. Closure 18 is then screwed on and secured.

The other piece of the two-piece tool comprises wash handle 39 about 12 inches long made of lightweight tubing with handle grip 44 installed on one end with hole 27 about 10 inches from said handle grip 44. The other end flattened and bent on about a 30° angle 41 the flattened end 40 is fastened to the center of flexible plastic board 38. A hole 23 and 25 is drilled through the center of flattened end 40 and flexible plastic board 38 and counter-sunk 37 on the bottom side. Soap water tube fitting 46 is placed in hole 27 and counter-sink 37 and tightened with nut 30. One end of soap water tube 12 is put through the end of wash handle 39 and brought out through hole 35 in wash handle 39 and then screwed onto soap water tube fitting 46. A replaceable wash pad 36 comprising a soft artificial sheepskin material of prior art manufactured by Tex Tenn (style number 122-3022) with drawstring 43 threaded through casing 42 is tied securely over the entire front and partly over the back of flexible plastic board 38. Finally the free end of soap water tube 12 is screwed onto soap water jet 20 whereby interconnecting said two-piece tool.

While we have described in some detail the over all physical structure of the two-piece tool of the invention. We would like to describe some of the separate parts in more detail.

Figure 4:
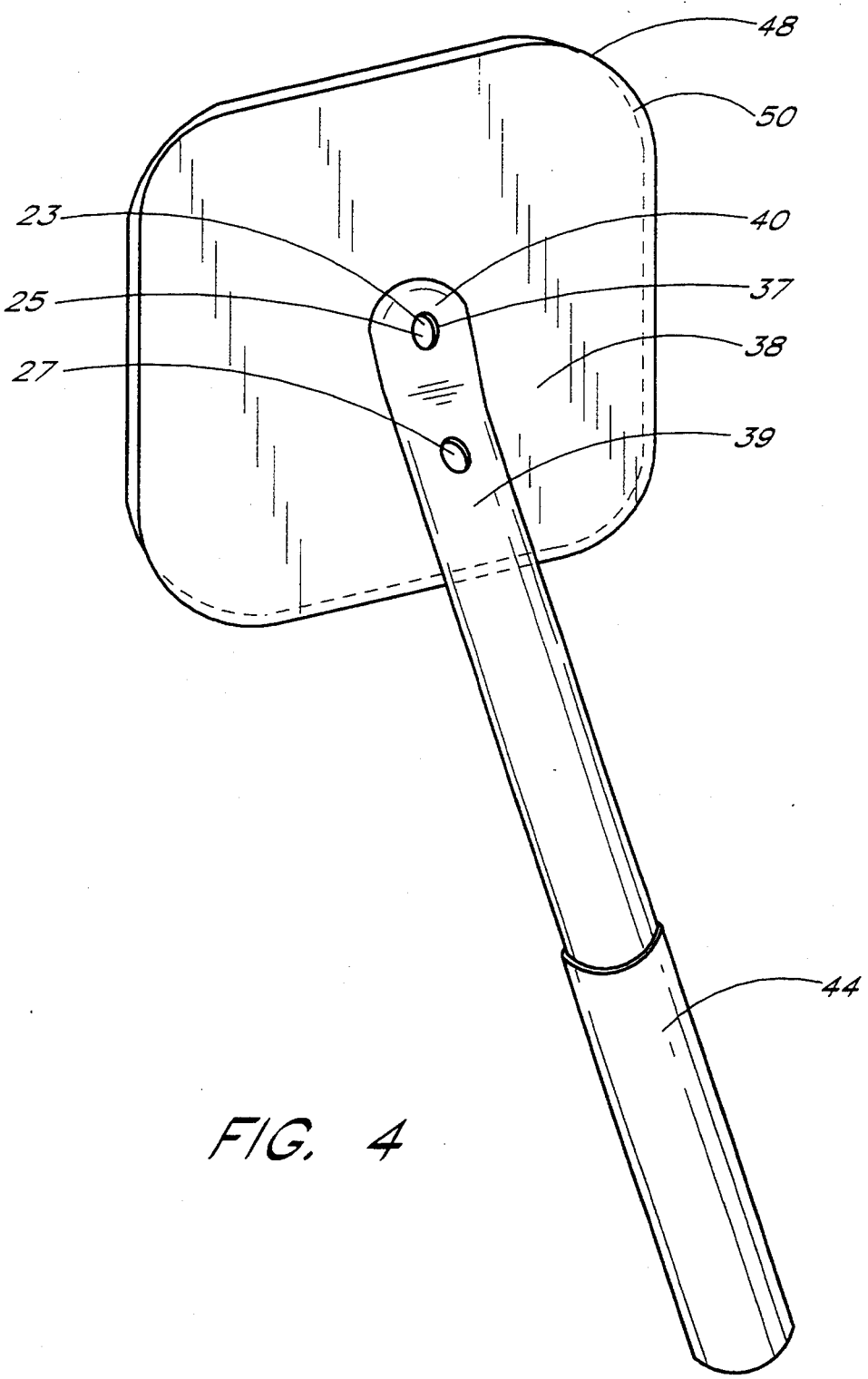
FIG. 4 shows a perspective back view of a wash board assembly of such tool.

The wash board assembly FIG. 4 comprises a wash handle 39 made from a piece of lightweight tubing about 12 inches long. Handle grip 44 is tightly fitted to one end, the other end is flattened and bent on about a 30° angle, hole 23 is then drilled in the center of the flattened end 40. Another hole 27 is drilled through one side of wash handle 39 about 2 inches from flattened end 40. The flexible plastic board 38 is made from a piece of P.V.C. foam board trade name Trovicel, manufactured by Huls (number 923412) and is cut about 6 inches square. The corners are rounded 48 and beveled 50 on the front side. Hole 25 is drilled and counter-sunk 37 on the bottom side of flexible plastic board 38. The flattened end 40 of wash handle 39 is then fastened to the center of flexible plastic board 38.

Figure 5:
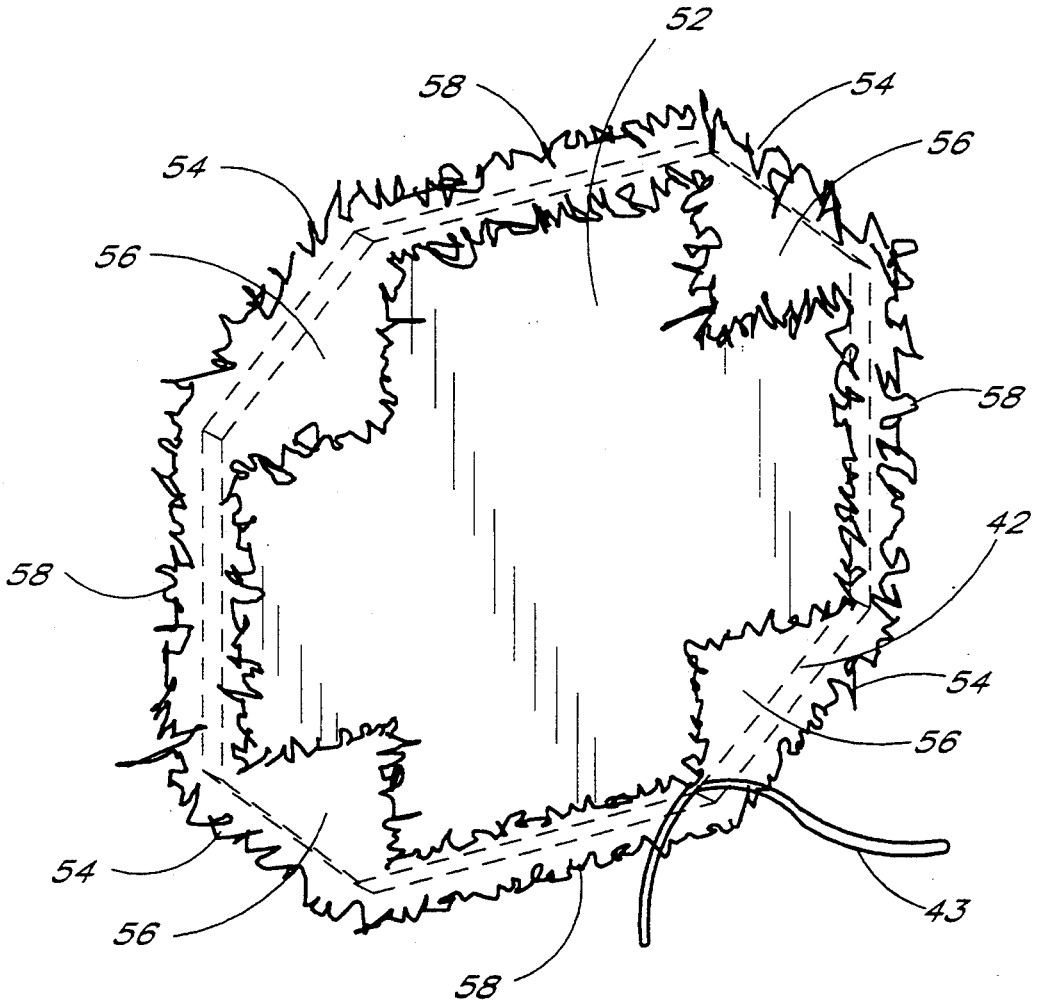
FIG. 5 shows a perspective back view of a replaceable wash pad and drawstring of such tool.

The wash pad FIG. 5 comprises an artificial sheepskin like material with an acrylic backing 52 and is cut about 10 inches square. The four corners are folded 54 against the acrylic backing 52 in about a two inch fold toward the center and then glued to acrylic backing 52 with hot glue forming a casing 42 for drawstring 43. The edges are then folded 58 in about a ½ inch fold and glued to acrylic backing 52 forming a casing 42 for drawstring 43.

Figure 6:
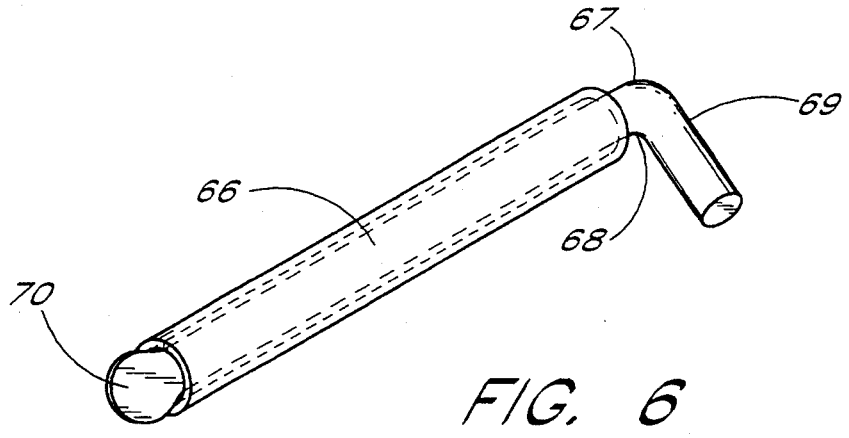
FIG. 6 shows an enlarged detailed perspective bottom view of a self-cleaning water jet of such tool which automatically water from the rinse nozzle and for use in automatically controlling the feed rate of concentrated liquid soap.

Self-cleaning water jet FIG. 6 comprises a rigid tube 66 about 1/16 inches in diameter and about 5/16 inches long and a rigid rod 67 about 1/32 inches in diameter and about ½ inch long. Rigid rod 67 is bent on about a 90° angle 68 about ¼ inch from the one end forming a lever 69. Rigid rod 67 is slipped through rigid tube 66 and crimped 70 on the other end of rigid rod 67 forming a flattened tab about 1/32 inch thick and about 3/64 inch in diameter which prevents rigid rod 67 from slipping out of rigid tube 66 whereby lever 69 is automatically turned about 180° when sponge 16 is removed or replaced which keeps self-cleaning water jet FIG. 6 clean. Lever 69 can also be rotated with forefinger very easily to facilitate more cleaning.

Figure 7:
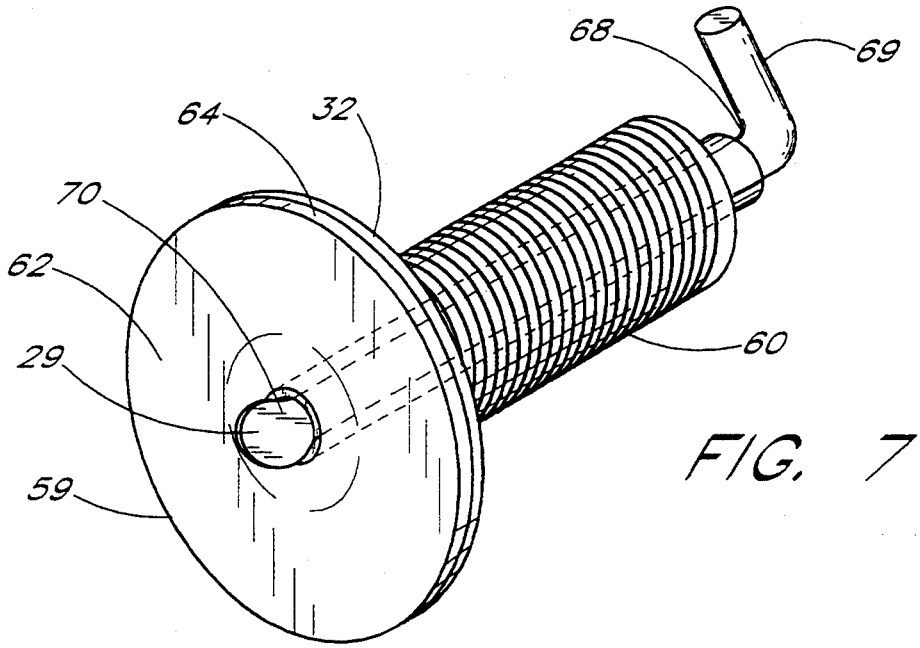
FIG. 7 shows an enlarged detailed perspective bottom view of a rear mounting post assembly of such tool for mounting the plastic bottle to the rinse nozzle.

Rear mounting post assembly FIG. 7 comprises a nylon screw 60 about 3/16 inches in diameter and about 3/8 inches long with a hole 29 drilled through the center; the head 59 of nylon screw 60 is machined to a flat surface 62 leaving an edge 64 about 3/64 inches thick. Self-cleaning water jet FIG. 6 is then pressed into hole 35 of nylon screw 60.

Figure 8:
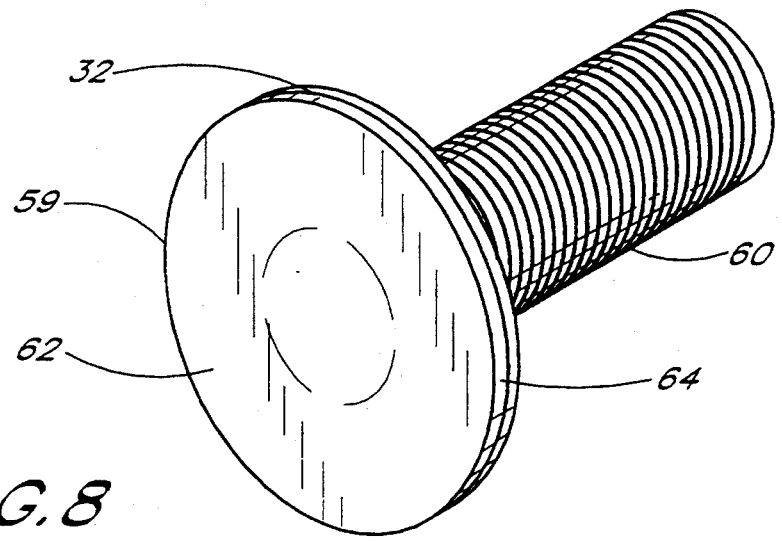
FIG. 8 shows and enlarged detailed perspective bottom view of a front mounting post of such tool for mounting plastic bottle to the rinse nozzle.

Front mounting post FIG. 8 comprises a nylon screw 60 about 3/16 inches in diameter and about 3/8 inches long with the head 59 of nylon screw 60 machined to a flat surface 62 leaving the edge 64 about 3/64 inch thick.

Figure 9:
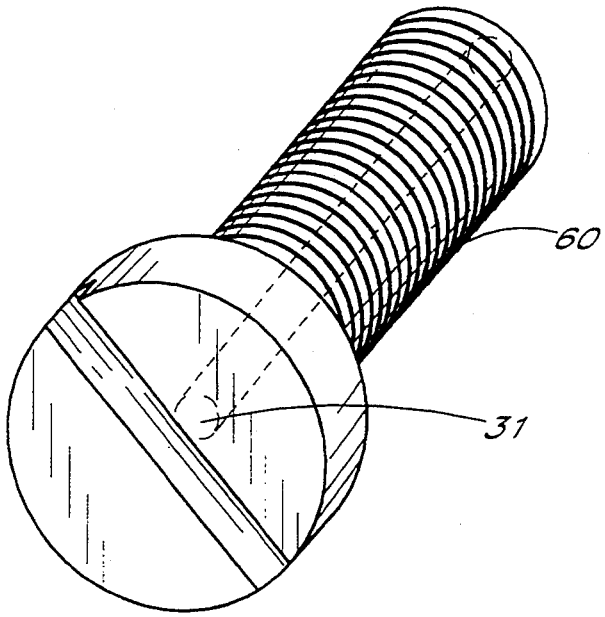
FIG. 9 shows an enlarged detailed perspective bottom view of a soap water jet of such tool for dispensing soapy water from the plastic bottle to the soap water tube.

Soap water jet FIG. 9 comprises a nylon binder-head screw 60 about 3/16 inch diameter and about 3/8 inches long with hole 31 about 1/16 inch diameter drilled through the center.

Figure 10:
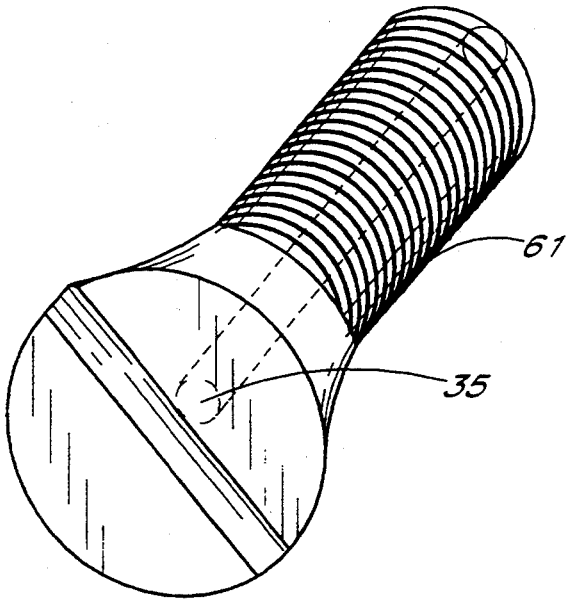
FIG. 10 shows an enlarged detailed perspective bottom view of a soap water tube fitting of such tool for dispensing soapy water to the wash pad.

Soap water tube fitting FIG. 10 comprises a nylon flathead screw 61 about 3/16 inches in diameter and about 3/8 inches long with hole 35 about 1/16 inches diameter drilled through the center.

Figure 11:
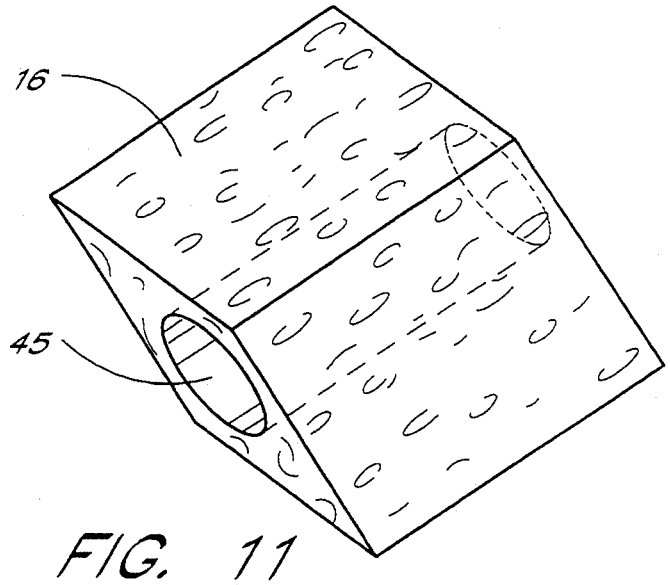
FIG. 11 shows an approximate actual size in a perspective side view, a rectangular sponge of such tool.

Rectangular sponge FIG. 11 comprises a sponge 16 about 1½ inches wide and 1¾ inches long with a hole 45 about ½ inch in diameter through the center.

Figure 12:
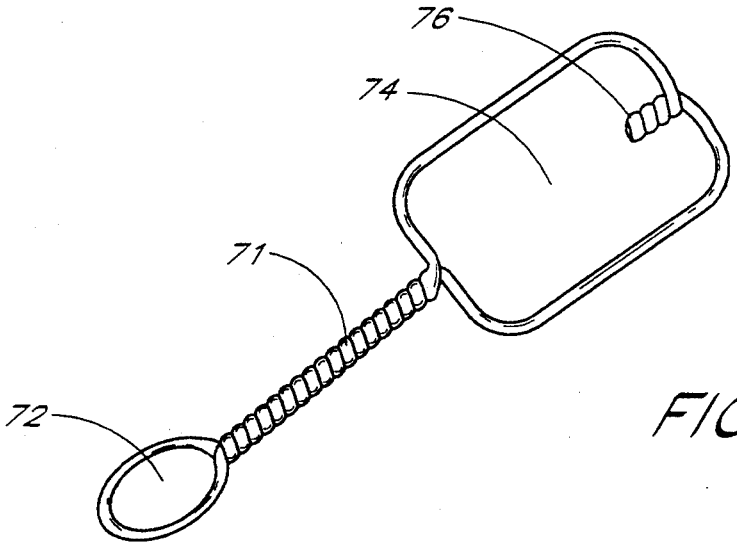
FIG. 12 shows an approximate actual size in a perspective sideview, a sponge handle of such tool used for removing and replacing the sponge and for preventing the sponge from shifting back and forth in the plastic bottle.

Sponge handle FIG. 12 comprises a metal wire about size 16 twisted to form a stem 71 about ¾ inch long and eyelet 72 about ½ inch in diameter, and a rectangle 74 about ¾ wide and about 1 inch long with the two twisted ends 76 bent inward and parallel with said stem 71.

Figure 13:
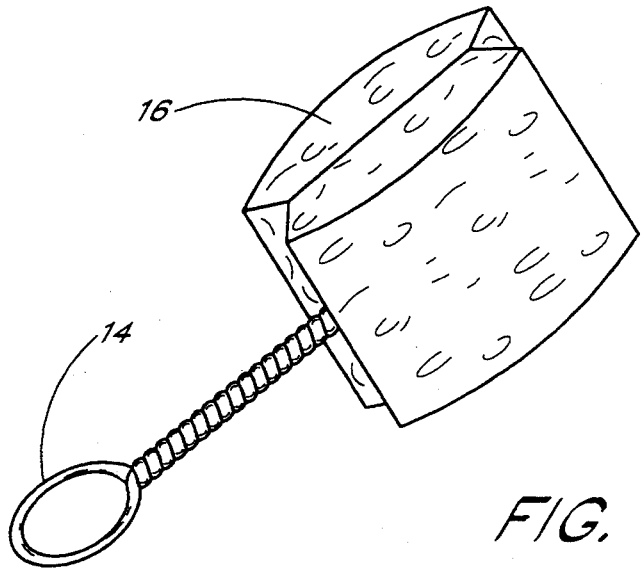
FIG. 13 shows an approximate actual size in a perspective side view, a sponge of such tool used for storing liquid soap.

Sponge FIG. 13 comprises rectangular sponge 16 fitted into sponge handle 14.

Extension handle FIG. 14 comprises a piece of lightweight plastic tubing 79 about 7/8 inch in diameter and about 26 inches long. One end is heated to from an inverted crease 77 about 3/16 inches wide, ¼ inches deep and 3 inches long with handle grip 44 on the other end.

Extension section FIG. 15 comprises extension handle FIG. 14 without handle grip 44.

Soap water extension tube FIG. 16 comprises a piece of flexible plastic tubing 12 with an outside diameter of about 3/16 inches, inside diameter of about 1/8 inch and about 22 inches long. Soap water tube connector 78 is made of a piece of threaded nylon rod about 3/16 inch in diameter and about ½ inch long with a hole 35 through the center and is screwed and glued into one end of plastic tubing 12 leaving about ¼ inches of the threads exposed.

Two-piece Tool Operation

Figure 2:
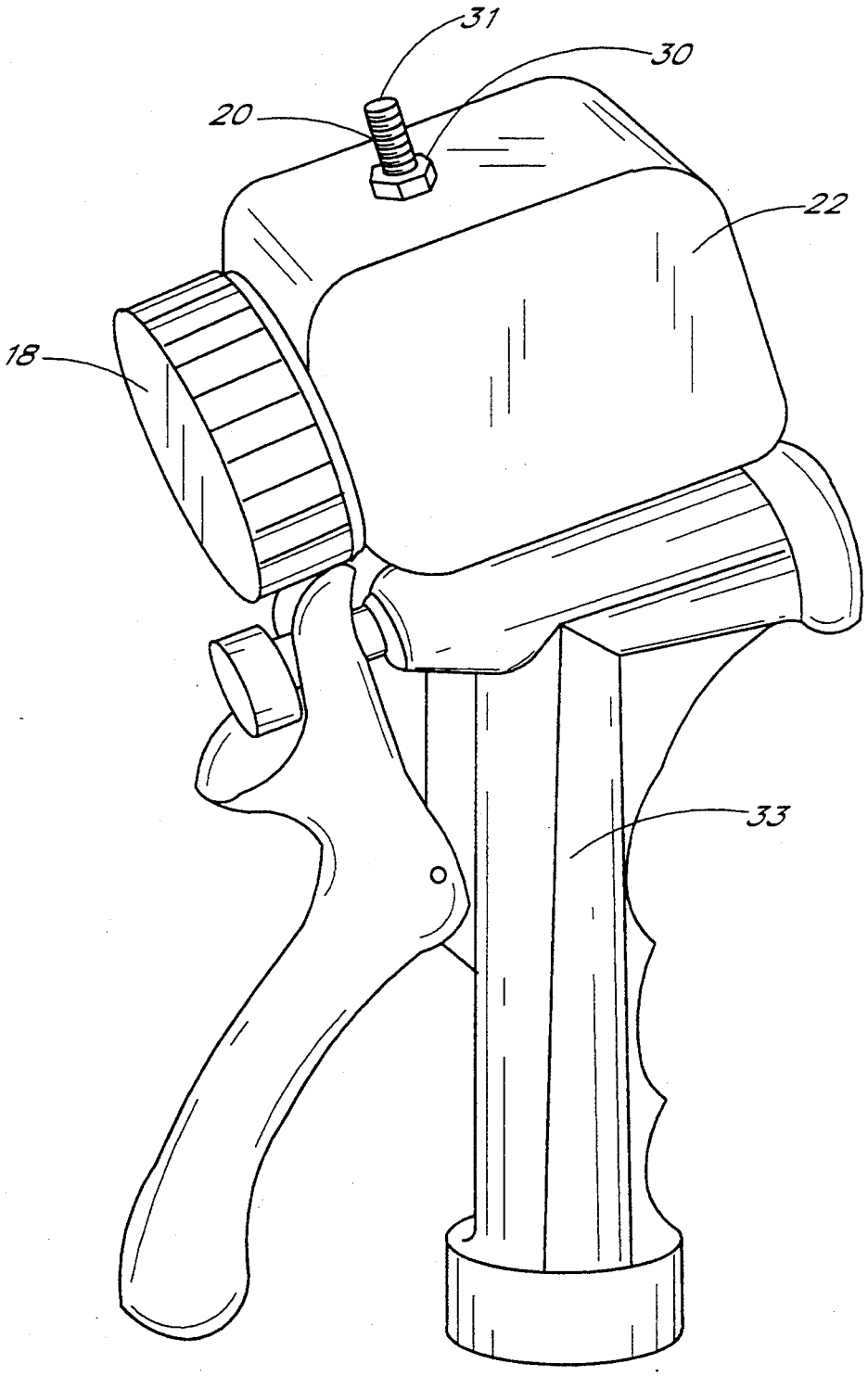
FIG. 2 shows an approximate actual size in a perspective side view, a rinse nozzle assembly of such tool which automatically dispenses a small continuous amount of soapy water to the wash pad and for use in manually rinsing with clear water.

The two-piece tool of FIG. 1 will perform a wide variety of cleaning functions, but users will find it most useful for washing cars. For this function the user removes closure 18 from plastic bottle 22 and pours about one ounce of liquid soap into plastic bottle 22 partially saturating sponge 16. The user then replaces closure 18 and screws rinse nozzle assembly FIG. 2 onto the garden hose and turns on the water. Immediately water is dispensed from hose nozzle gun 33 through self-cleaning water jet 24 into plastic bottle 22 and sponge 16. The soap gradually dissipates from sponge 16 as it mixes with the incoming water and is dispensed out the top of plastic bottle 22 through soap water jet 20, soap water tube 12, soap water tube fitting 46, and finally into wash pad 36 at the rate of about two ounces per minute which is an ample amount of soapy water to maintain a good lather throughout the operation.

Figure 3:
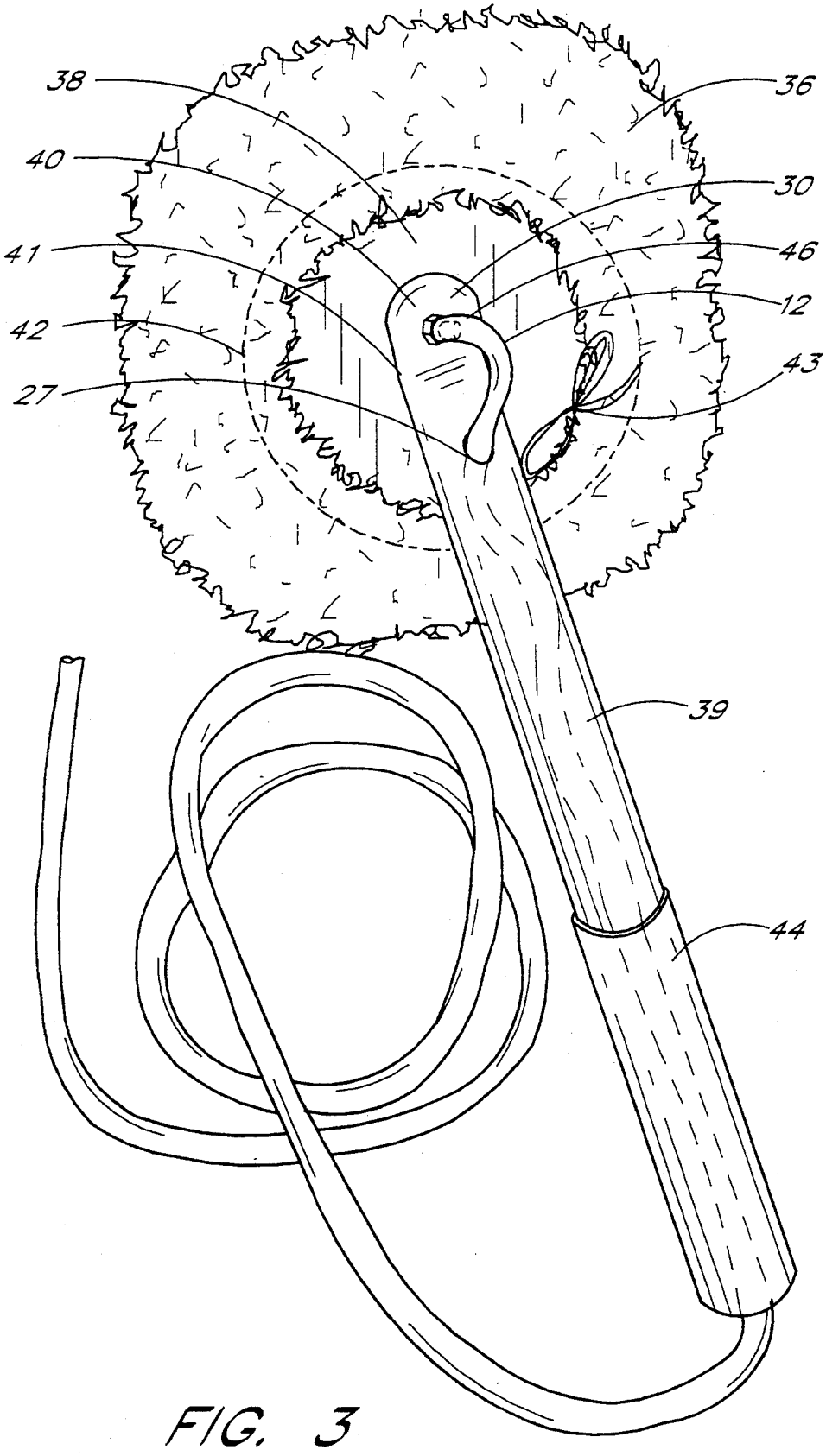
FIG. 3 shows a perspective back view of a wash handle assembly of such tool for use in washing, and dusting.
Figure 17:
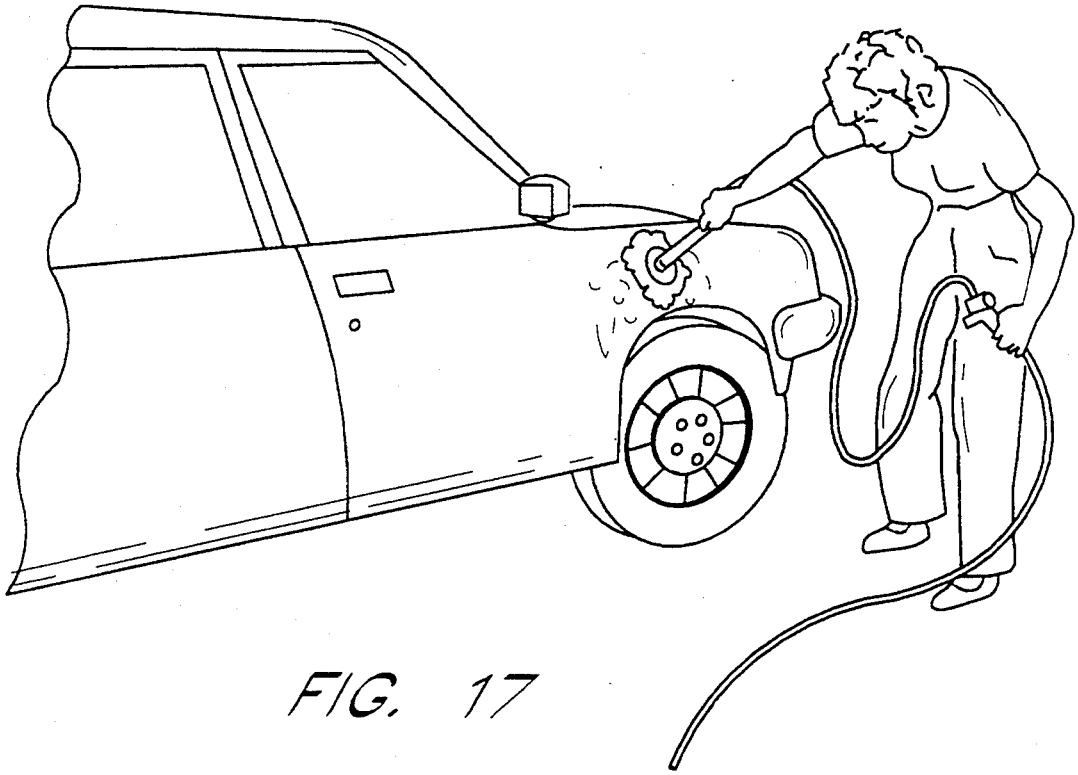
FIG. 17 shows an illustration of a woman washing a car with the use of such tool.
Figure 18:
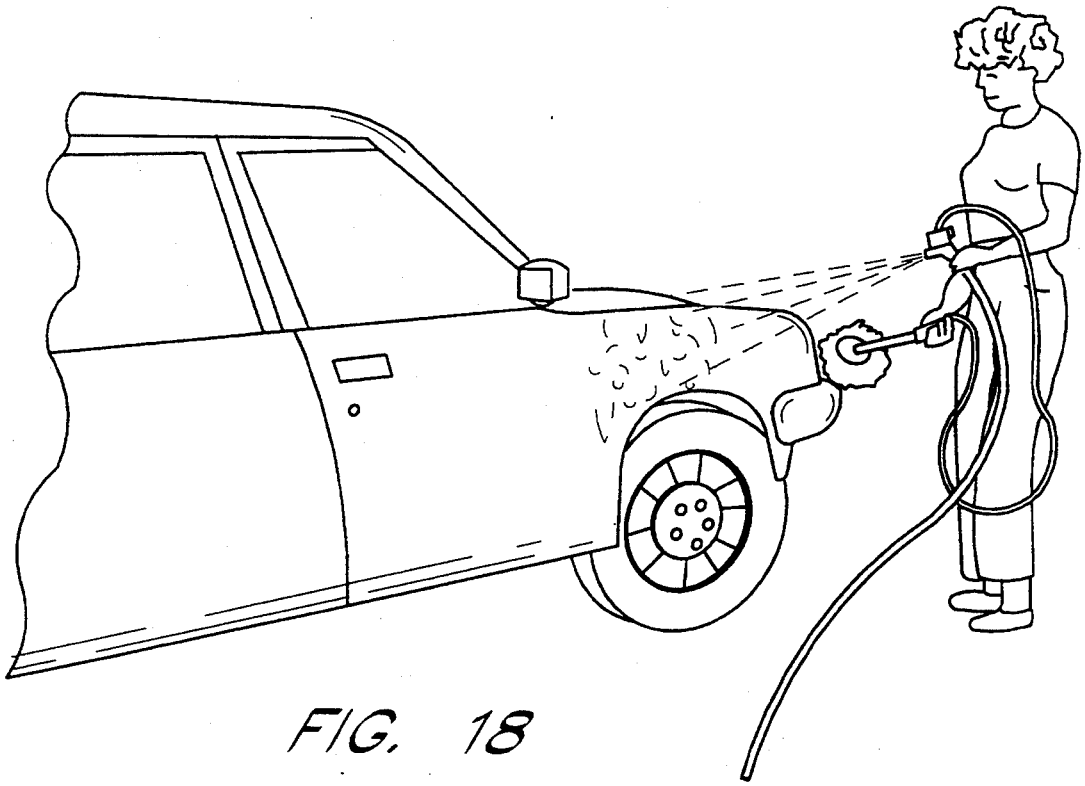
FIG. 18 shows an illustration of a woman rinsing a car with the use of such tool.

The user then takes one piece of the tool in each hand. With the use of rinse nozzle assembly FIG. 2 in one hand, the user rinses off the loose dirt and cools down the hot metal surface of a section of the car to be washed (preferably the roof to begin with) as illustrated in FIG. 18. This process also provides added water to the surface of the car prior to washing. Using the wash handle assembly FIG. 3 in the opposite hand, the user then washes the same pre-rinsed section of the car as illustrated in FIG. 17. With the use of rinse nozzle assembly FIG. 2 the user again rinses the car as before, only this time rinsing off the soap instead of the loose dirt as illustrated in FIG. 18. The user then proceeds to the next section of the car, and repeats the previous operations until the car is completely washed. Next the user turns off the water and unscrews rinse nozzle assembly FIG. 2 from the garden hose. The user then rinses and partially dries out the wash pad 36 by swinging the handle and wash pad assembly FIG. 3 in a downward motion snapping the wrist to remove excess water in the way one would clean a paint brush. Lastly, the user dries the car with a cloth or chamois. After about five car washes, the user removes the sponge FIG. 13, and squeezes out any water before refilling it with liquid soap.

While we have described the process of washing a car with the tool of the invention in some detail, in practice we have found that it can be performed very quickly and neatly without the user getting wet.

Figure 19:
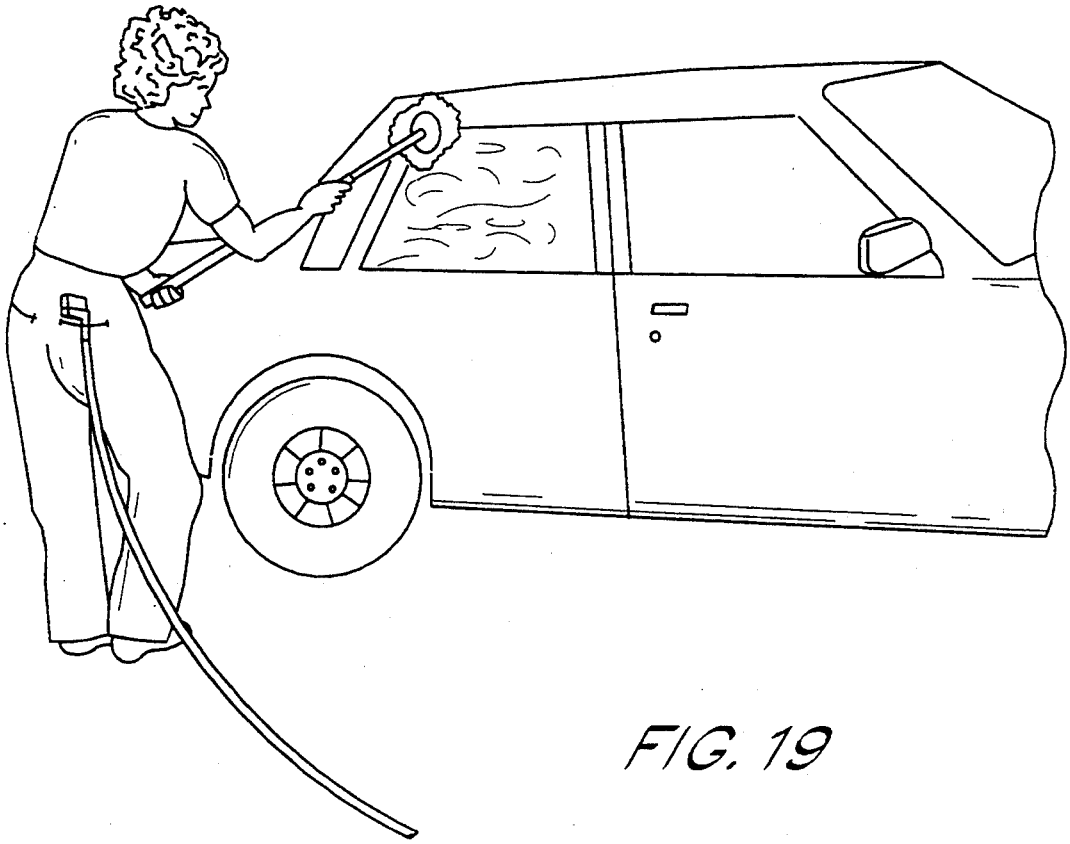
FIG. 19 shows an illustration of a woman washing a car with the use of such tool when equipped with an extension handle and soap water extension tube.
Figure 20:
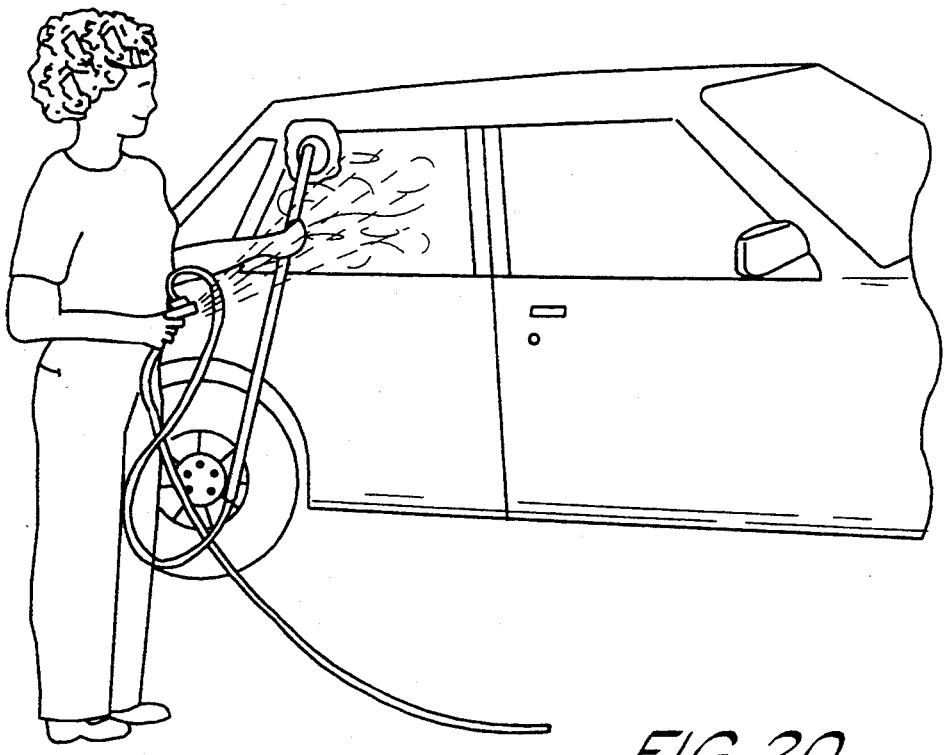
FIG. 20 shows and illustration of a woman rinsing a car with the use of such tool when equipped with an extension handle and soap water extension tube.

Conventional Car Washer: Users can use the tool in a more conventional way by adapting an extension handle FIG. 14, and a soap water tube extension FIG. 16, to wash handle 39 and soap water tube 12. In this case to wash the car FIG. 19, the user places the handle of rinse nozzle and assembly FIG. 2 in the pocket or waistband of their clothing and holds end handle grip 44 with one hand and mid handle grip 44 with the other hand. This method is desirable for short people when washing the roof because it provides a longer reach. To rinse FIG. 20 the user simply removes the handle of rinse nozzle assembly FIG. 2 from their clothing and rinses with one hand while holding wash handle 39 with the other hand.

Figure 21:
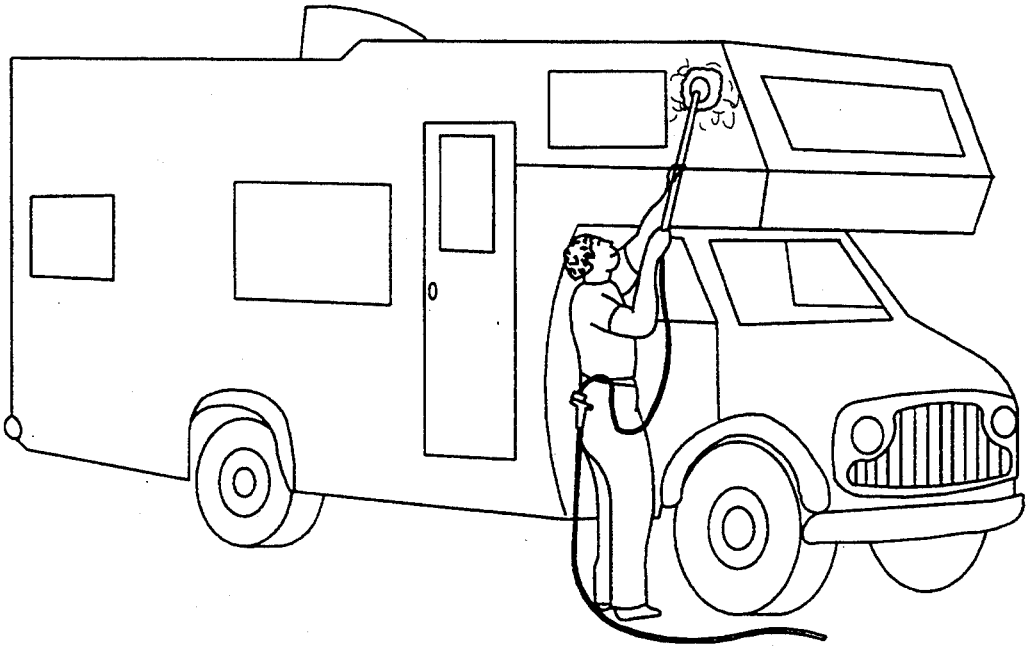
FIG. 21 shows an illustration of a man washing an R.V. with the use of such tool, when equipped with an extension handle and soap water extension tube.
Figure 22:
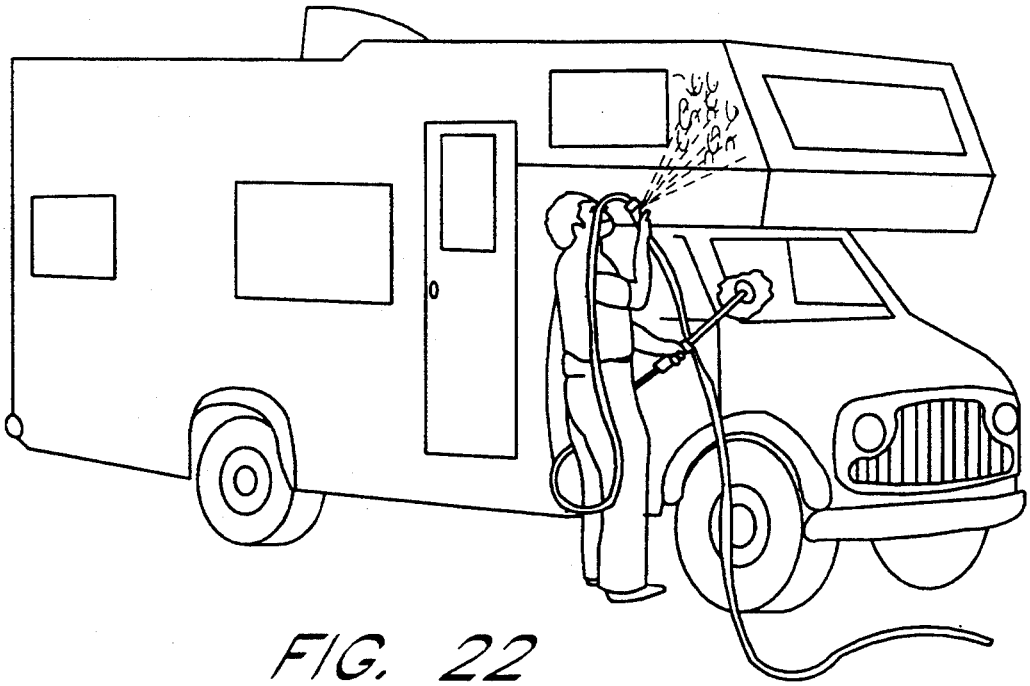
FIG. 22 shows an illustration of a man rinsing an R.V. with the use of such tool when equipped with an extension handle and a soap water extension tube.

R.V. Washer: The conventional car washer method is used when washing R.V.'s FIG. 21 and rinsing R.V.'s FIG. 22.

Figure 24:
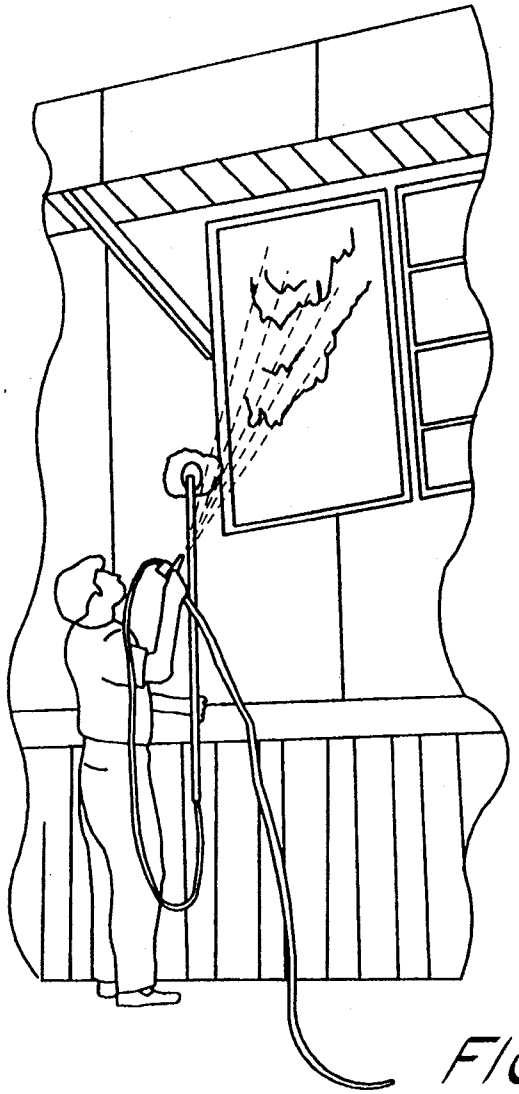
FIG. 24 shows an illustration of a man rinsing a mobilehome and windows with the use of such tool when equipped with an extension handle, extension section, and soap water extension tube.
Figure 23:
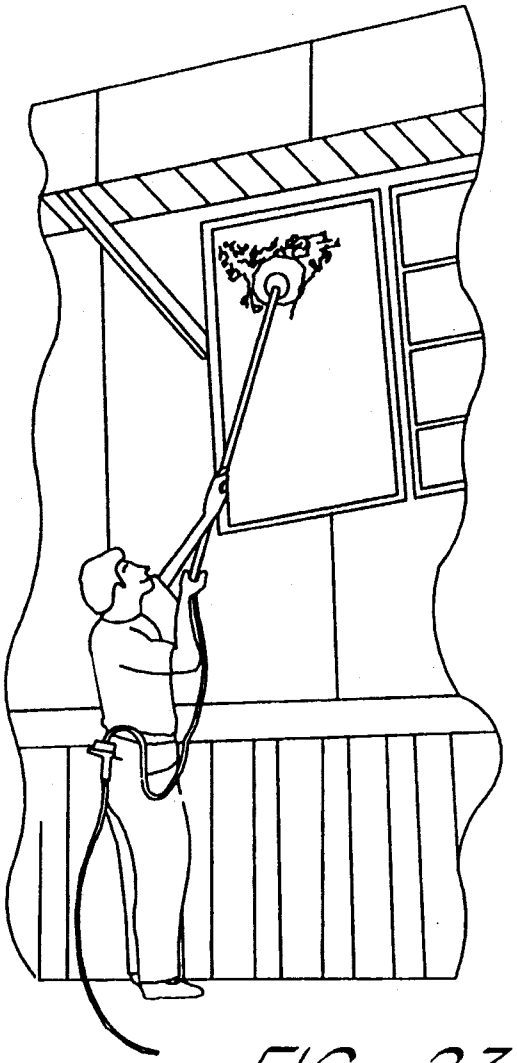
FIG. 23 shows an illustration of a man washing a mobilehome and windows with the use of such tool, when equipped with an extension handle, extension section, and soap water extension tube.

Mobilehome Washer: The conventional car washer method is used when washing mobilehomes, second story windows, or other high objects FIG. 23, by adding one or more extension sections FIG. 15, and soap water tube extensions FIG. 16. In this case, the user holds the end handle grip 44 with one hand and finds a comfortable place on the extension handle for the other hand. A narrow jet rinse is used for high objects FIG. 24.

While the above description contains many specificities the reader should not construe these as limitations on the scope of the invention but merely exemplifications of preferred embodiments thereof. For example, skilled artisans will readily be able to change the dimensions and shapes of the various embodiments. They can make the hose nozzle gun embodied in a mold with means for mounting a soap reservoir such as a raised flat surface on the barrel with mounting holes or they can make the mounting posts molded into the same embodiment with one hole for mounting a water jet. They can make the rinse nozzle and soap plastic bottle assembly FIG. 2, embodied in one mold. They can use many different kinds of soap storage devices such as a tea bag filled with a granulated soap or a highly concentrated soap in a solid form like a bar or tablets. All could be made to fit into a soap reservoir and gradually dissipate out to the wash head of a car washer as it mixes with incoming water. They can make the wash board assembly embodied in one mold. They can make the sponge with a tab glued on the top in the shape of the inside cross section of the soap reservoir so the user can squeeze out the water from the sponge prior to filling with soap by pushing on said tab with forefinger while tipping the soap reservoir so the excess water will run out. They can make the flexible board embodied in one mold. They can sew instead of glue the seams on the wash pad. They can make the wash handle assembly FIG. 3 with a brush on the end instead of a wash pad. They can make a brush without a handle. They can make a wash mitt with means for interconnecting the flexible tube. They can make the flexible tube out of various plastics or rubber. They can use a wide variety of jets or fitting to attach to the flexible tube. They can use a one-piece gasket instead of neoprene washers for sealing off leakage between the mounting post and hose nozzle gun. Accordingly the reader is requested to determine the scope of the invention by the appended claims and their equivalents and not by the examples which have been given.

We claim:

1. A car washer for performing a pre-rinse, a soap and water wash, and a finish rinse in successive intervals, to accomplish a clean and well-rinsed wash, using a minimal amount of soap and water comprising:

a two-piece tool interconnected with a flexible soap water tube, means for manual instantaneous flow control rinsing, a sponge for storing concentrated liquid detergent, means for automatically controlling the feed rate of concentrated liquid detergent from said sponge, means for dispensing soapy water from the first piece of said two-piece tool to the second piece of said two-piece tool, a wash handle assembly for washing, an extension handle for extending the length of said wash handle assembly, and a soap water extension tube.

2. The car washer of claim 1 wherein said means for manual instantaneous flow control rinsing comprises a garden hose nozzle gun with means for mounting a plastic bottle.

3. The car washer of claim 2 wherein said means for mounting said plastic bottle comprises two mounting holes about 3/16 inch in diameter spaced about ¾ inch apart on the top side of the barrel near the rear of garden hose nozzle gun, said top side of said barrel is machined to a flat surface with a front mounting post and a rear mounting post placed in said mounting holes and tightened with two nuts against said flat surface.

4. The car washer of claim 3 wherein said front mounting post comprises a nylon screw about 3/16 inch in diameter and about 3/8 inch long with a flexible head about 3/8 inch in diameter and about 3/64 inch thick with a neoprene washer about 1/32 inch thick having an outside diameter of about 3/8 inch and an inside diameter of about 11/64 inch, said neoprene washer is press-fitted against the underside of said flexible head, and thus fitted is pushed up through the front mounting hole and tightened with a nut; wherein said flexible head and said neoprene washer conforms to the inside curvature of the barrel of said garden hose nozzle gun and prevents water leakage, said nut providing spacing between said garden hose nozzle gun and said plastic bottle.

5. The car washer of claim 3 wherein said rear mounting post comprises a mounting post with a hole about 1/16 inch in diameter through the center with a self-cleaning water jet pressed into said hole of said rear mounting post.

6. The car washer of claim 1 wherein said sponge for storing concentrated liquid detergent comprises a rectangular sponge about 1½ inches wide and about 1¾ inches in length with a hole about ½ inch in diameter through the center and parallel with said length, said sponge compressed and fitted into a sponge handle.

7. The car washer of claim 6 wherein said sponge handle comprises a wire about size 16 twisted to form a stem about ¾ inch long with an eyelet about ½ inch in diameter and a rectangle about ¾ inch wide and about 1 inch long with 2 twisted ends bent inward pointing in the direction and parallel of said stem.

8. The car washer of claim 1 wherein said means for automatically controlling the feed rate of concentrated liquid detergent from sponge includes a self-cleaning water jet comprising a rod about 1/32 inch in diameter and about ½ inch long, said rod extending through a tube having an inside diameter of about 3/64 inch and outside diameter of about 1/16 inch and about 5/16 inch long, said rod having a thickness of about 1/64 inch and a diameter of about 3/64 inch on one end and bent on the opposite end at about a 90° angle approximately ¼ inch from the end forming a lever, wherein the self cleaning water jet is adapted to expel a continuous stream of water into the sponge, whereby the concentrated liquid detergent slowly dissipates from the sponge.

9. The car washer of claim 1 wherein said means for automatically controlling the feed rate of concentrated liquid detergent from the sponge includes a plastic bottle, with closure, about 2¾ inches long and about 1¼ inches wide, with a capacity of approximately two liquid ounces, with two mounting holes through one side spaced about ¾ inch apart and a hole through the opposite side of said two mounting holes, wherein the plastic bottle is adapted to house the sponge, whereby the water continually circulates through the sponge and slowly dissipates the concentrated liquid detergent from the sponge and mixes to provide a suitable solution for washing.

10. The car washer of claim 1 wherein said means for dispensing soapy water from the first piece of said two-piece tool to the second piece of said two-piece tool includes a soap water jet comprising a nylon binder head screw about 3/16 inch in diameter and about 3/8 inch long with a hole about 1/16 inch in diameter through the center and parallel with said binder head screw.

11. The car washer of claim 1 wherein said means for dispensing soapy water from the first piece of said two-piece tool to the second piece of said two-piece tool comprises a soap water tube fitting comprising a nylon flathead screw about 3/16 inch in diameter and about 3/8 inch long with a hole about 1/16 inch in diameter through the center and parallel with said flathead screw, wherein said flathead screw is placed in a counter-sunk hole through a flattened end of a lightweight tube, through a flexible board, and tightened with a nut.

12. The car washer of claim 1 wherein said means for dispensing soapy water from the first piece of said two-piece tool to the second piece of said two-piece tool includes a soap water tube comprising a flexible tube with a outside diameter of about 3/16 inch and a inside diameter of about 1/8 inch and approximately 6 feet long.

13. The car washer of claim 1 wherein said wash handle assembly for washing comprises a lightweight tube about 12 inches long with a handle grip installed on one end with the other end flattened and bent on about a 30° angle with a hole through the center of said flattened end and a hole about 2 inches from said flattened end, and a flexible plastic board about 1/16 inch thick about 6 inches long and 6 inches wide, rounded and beveled on the corners, with a hole in the center and counter-sunk on one side and fastened to the center of said flattened end, and a wash pad attached to said flexible plastic board.

14. The car washer of claim 13 wherein said wash pad comprises an artificial sheepskin-like material with an acrylic backing about 10 inches square, the four corners folded against the acrylic backing in about a 2 inch fold toward the center and glued to said acrylic backing forming a casing for a drawstring, the four edges folded in about a ½ inch fold parallel to said edges and glued to said acrylic backing forming a casing for said drawstring, whereby wash pad can be replaced when worn out.

15. The car washer of claim 1 wherein said extension handle for extending the length of said wash handle assembly comprises a lightweight plastic tube about 26 inches long with an inverted crease on one end about 3/16 inch wide and ¼ inch deep and about 3 inches long, wherein the extension handle is adapted to be inserted into the end of the wash handle to a depth of about 3 inches when the handle needs to be lengthened.

16. The car washer of claim 1 wherein said soap water extension tube for extending the length of said soap water tube comprises a piece of flexible tubing with an outside diameter of about 3/16 inch and an inside diameter of about 1/8 inch and approximately 22 inches long with a piece of threaded nylon rod about 3/16 inch in diameter and about ½ inch long with a hole about 1/16 inch in diameter through the center, said threaded nylon rod is screwed and glued into one end of said soap water extension tube.

* * * * *